US006719223B2

(12) United States Patent
Yukinawa et al.

(10) Patent No.: US 6,719,223 B2
(45) Date of Patent: Apr. 13, 2004

(54) FUEL INJECTION VALVE

(75) Inventors: Makoto Yukinawa, Atsugi (JP); Masatoshi Yanase, Atsugi (JP); Hiroaki Hirata, Atsugi (JP)

(73) Assignee: Unisia Jecs Corporation, Atsugi (JP)

( * ) Notice: Subject to any disclaimer, the term of this patent is extended or adjusted under 35 U.S.C. 154(b) by 259 days.

(21) Appl. No.: 10/050,113

(22) Filed: Jan. 18, 2002

(65) Prior Publication Data

US 2002/0100821 A1 Aug. 1, 2002

(30) Foreign Application Priority Data

Jan. 30, 2001 (JP) ..... 2001-022270

(51) Int. Cl.[7] ..... B05B 1/30

(52) U.S. Cl. ..... 239/584; 239/497; 239/552; 239/523; 239/524; 239/556; 239/596; 239/585.1

(58) Field of Search ..... 239/494, 497, 239/522, 523, 524, 543, 555, 556, 558, 584, 585.1, 585.4

(56) References Cited

U.S. PATENT DOCUMENTS 5,383,597 A * 1/1995 Sooriakumar et al. ..... 239/584
5,762,272 A * 6/1998 Tani et al. ..... 239/543
5,924,634 A * 7/1999 Arndt et al. ..... 239/596
6,070,812 A * 6/2000 Tani et al. ..... 239/552
6,170,763 B1 * 1/2001 Fuchs et al. ..... 239/596
6,330,981 B1 * 12/2001 Nally et al. ..... 239/585.1
6,394,367 B2 * 5/2002 Munezane et al. ..... 239/552
6,439,484 B2 * 8/2002 Harata et al. ..... 239/596
6,499,674 B2 * 12/2002 Ren et al. ..... 239/596

FOREIGN PATENT DOCUMENTS

JP 07-127550 5/1995

* cited by examiner

*Primary Examiner*—Steven J. Ganey
(74) *Attorney, Agent, or Firm*—Foley & Lardner

(57) ABSTRACT

A nozzle plate is provided with annular step portions each located on the periphery of a nozzle opening rim on a valve seat side, which rises up towards the nozzle opening rim from the radial outside of the nozzle, to form a fuel flow which flows in reverse from the radial outside to collide at an incline with a fuel flow which flows directly into the nozzle.

8 Claims, 8 Drawing Sheets

FUEL INJECTION VALVE

FIELD OF THE INVENTION

The present invention relates to a fuel injection valve suitable for injecting fuel into an automobile engine.

RELATED ART OF THE INVENTION

Heretofore, as a fuel injection valve used for an automobile engine, there is known one that incorporates a nozzle plate with a plurality of nozzles opened therein, on the downstream side of the valve seat (refer to Japanese Unexamined Patent Publication No. 7-127550).

Incidentally, in the above mentioned fuel injection valve which incorporates the nozzle plate, the smaller the diameter of the nozzles, the more the fuel is atomized. Therefore, it is preferable to make the diameter of the nozzles as small as possible.

However, there is a manufacturing limit to the minimum diameter for the nozzles. Moreover, if the diameter of the nozzles is too small, the nozzles are likely to be clogged.

Therefore, there has so far been the problem in that it is difficult to make the diameter of the nozzles even smaller to promote atomization of the fuel.

SUMMARY OF THE INVENTION

It is therefore an object of the present invention to provide a fuel injection valve of a construction wherein the outer diameter of a jet passing through the nozzle can be contracted, so that atomization of fuel can be promoted without reducing the diameter of the nozzle.

In order to achieve the above object, according to the present invention, a nozzle plate with a plurality of nozzles opened therein is provided with annular step portions each located on the periphery of a nozzle opening rim on a valve seat side, which rises up towards the nozzle opening rim from the radial outside of the nozzle, to form a fuel flow which flows in reverse from the radial outside to collide at an incline with a fuel flow which flows directly into the nozzle.

The other objects and features of this invention will become understood from the following description with reference to the accompanying drawings.

PREFERRED EMBODIMENTS

FIG. 1 to FIG. 10 show a first embodiment. In this embodiment, it is assumed that a fuel injection valve is applied to a vehicle engine.

Figure 1:
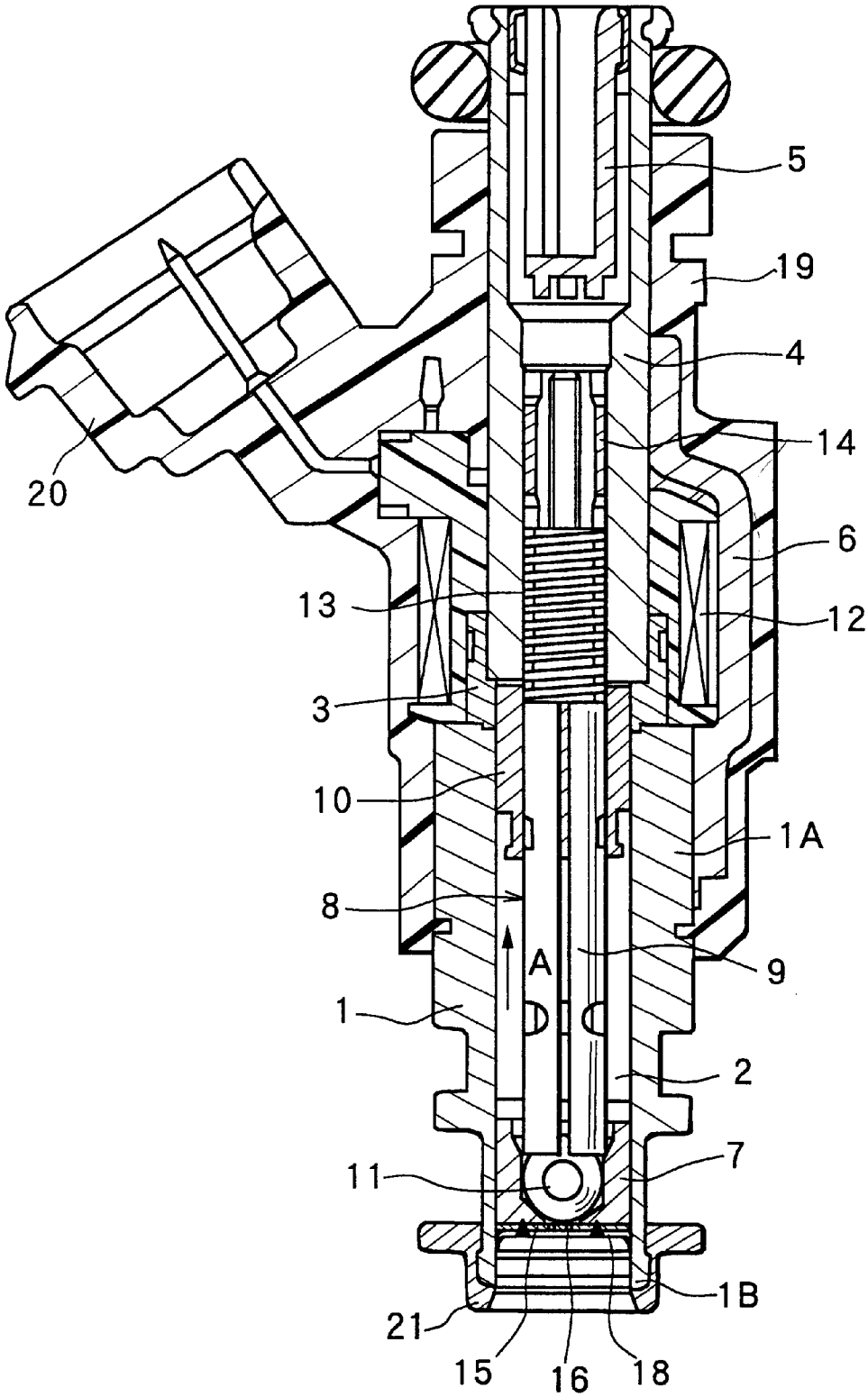
FIG. 1 is a longitudinal cross-section of a fuel injection valve showing a first embodiment.
Figure 2:
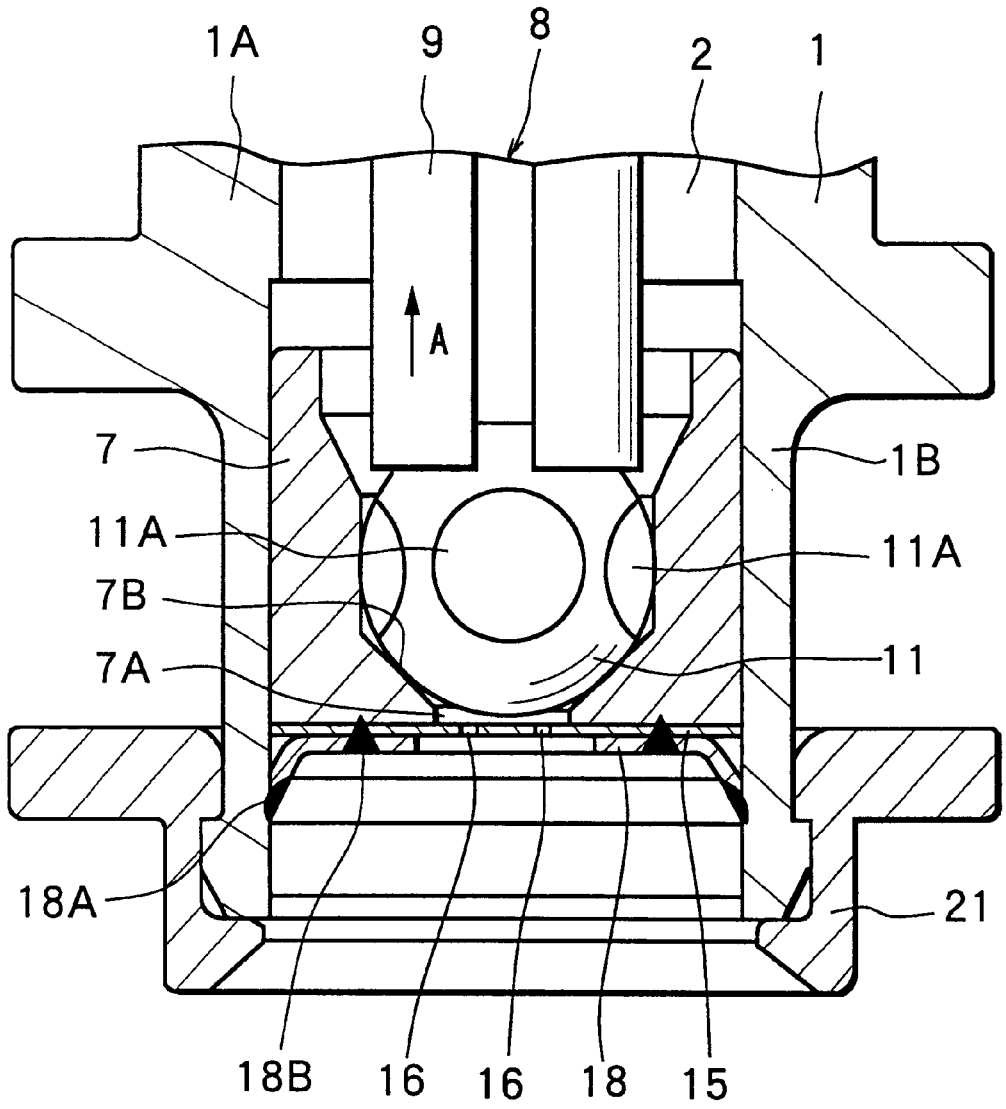
FIG. 2 is an enlarged cross-section showing a tip end of a casing shown in FIG. 1.
Figure 3:
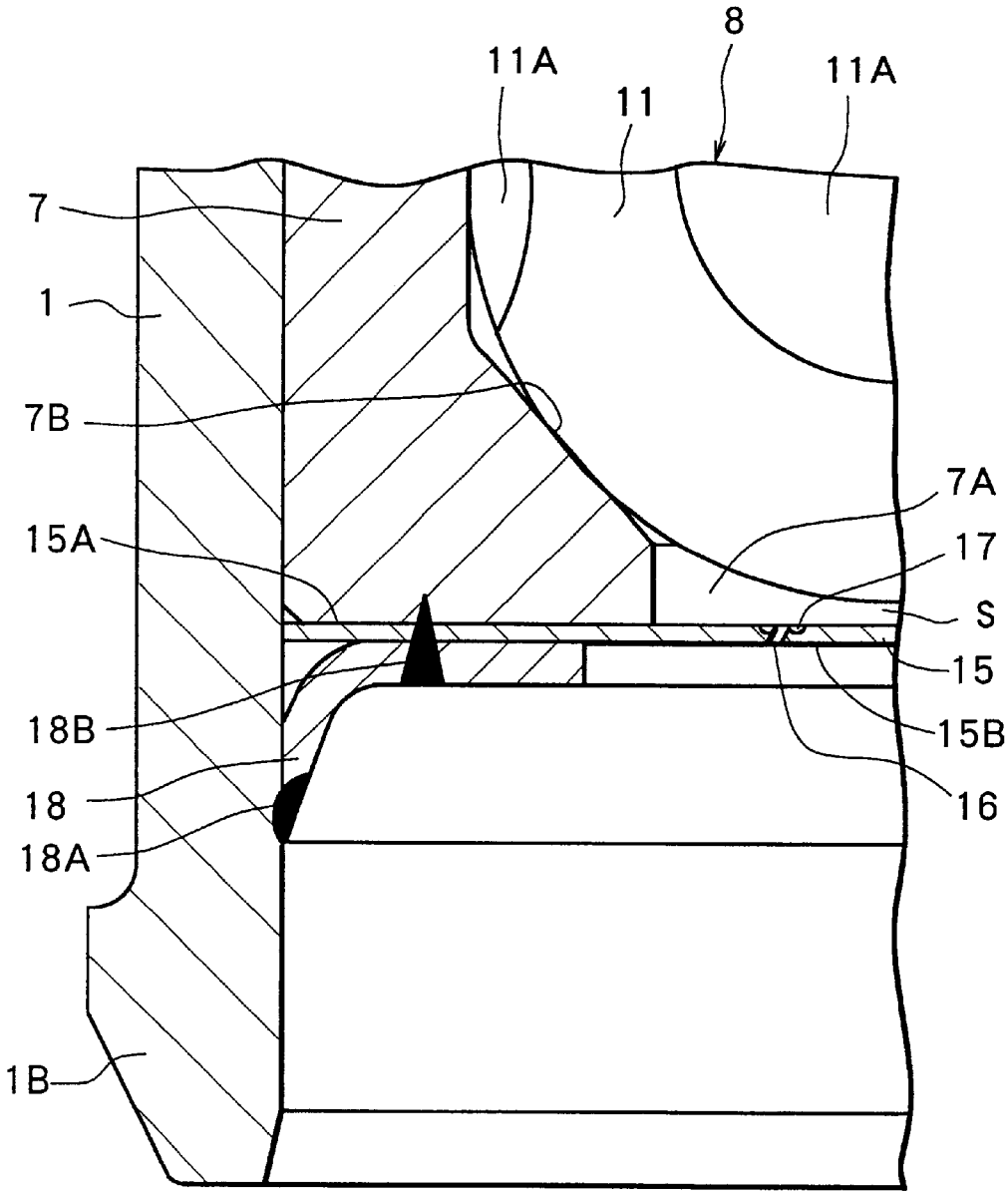
FIG. 3 is an enlarged cross-section of main parts of FIG. 2.

In FIG. 1 to FIG. 3, a casing 1 constituting a body of a fuel injection valve is formed in a cylindrical shape from electromagnetic stainless steel (magnetic material).

Casing 1 comprises a large diameter cylinder portion 1A with a resin cover 19 fitted to a base end thereof, and a small diameter cylinder portion 1B integrally formed on a tip end of large diameter cylinder portion 1A. A fuel passage 2 with a valve body 8 passing therethrough, is axially provided on the inside of casing 1.

A cylindrical connection member 3 is secured to the base end of casing 1. Connection member 3 is formed from a non-magnetic material, and is interposed between casing 1 and a fuel inflow pipe 4.

Fuel inflow pipe 4 is formed from an electromagnetic stainless steel (magnetic material). Fuel inflow pipe 4 is secured to the base end of casing 1 using connection member 3, and the tip end thereof is communicated with fuel passage 2. Furthermore, a fuel filter 5 is provided on an inner periphery of the base end of fuel inflow pipe 4.

Here, fuel inflow pipe 4 and casing 1 are magnetically connected to each other via a coupling core 6 comprising magnetic metal sheet, which is fitted to the outer peripheries of fuel inflow pipe 4 and casing 1.

Furthermore, when an electromagnetic coil 12 is supplied with a current, a closed magnetic circuit is formed between casing 1, fuel inflow pipe 4 and coupling core 6, and an attraction portion 10 of valve body 8.

A valve seat member 7 is inserted to the inside of small diameter cylinder portion 1B of casing 1. Valve seat member 7 is formed from a metal material or a resin material, and as shown in FIG. 2 and FIG. 3, is formed in an approximately cylindrical shape. Moreover, the tip end thereof is secured to the inner peripheral side of small diameter cylinder portion 1B via a nozzle plate 15 and a push plate 18.

Furthermore, on the inner peripheral side of valve seat member 7, there is provided an injection port 7A that is opened on the tip end of valve seat member 7, and an annular valve seat 7B formed in an approximate conical shape surrounding injection port 7A, for seating a valve portion 11 of valve body 8.

Valve body 8 is provided so as to pass through the inside of fuel passage 2 of casing 1. Valve body 8, as shown in FIG. 1 and FIG. 2, comprises a valve stem 9 formed by bending a metal plate into an approximately cylindrical shape, cylindrical attraction portion 10 formed from a magnetic material secured to the base end of valve stem 9, and spherical valve portion 11 secured to the tip end of valve stem 9 for being seated in valve seat 7B of valve seat member 7.

Here, the base end face of attraction portion 10 faces fuel inflow pipe 4 across an axial gap. The dimension of this gap is previously adjusted as a lift amount for valve body 8.

Furthermore, on the outer periphery of valve portion 11, there are provided chamfer portions 11A at a plurality of locations in a circumferential direction, and each of chamfer portions 11A forms a passage for fuel between valve seat member 7 and valve portion 11.

Moreover, when valve body 8 is closed, as shown in FIG. 3, valve portion 11 is seated in valve seat 7B of valve seat member 7 so that injection port 7A is closed.

Figure 6:
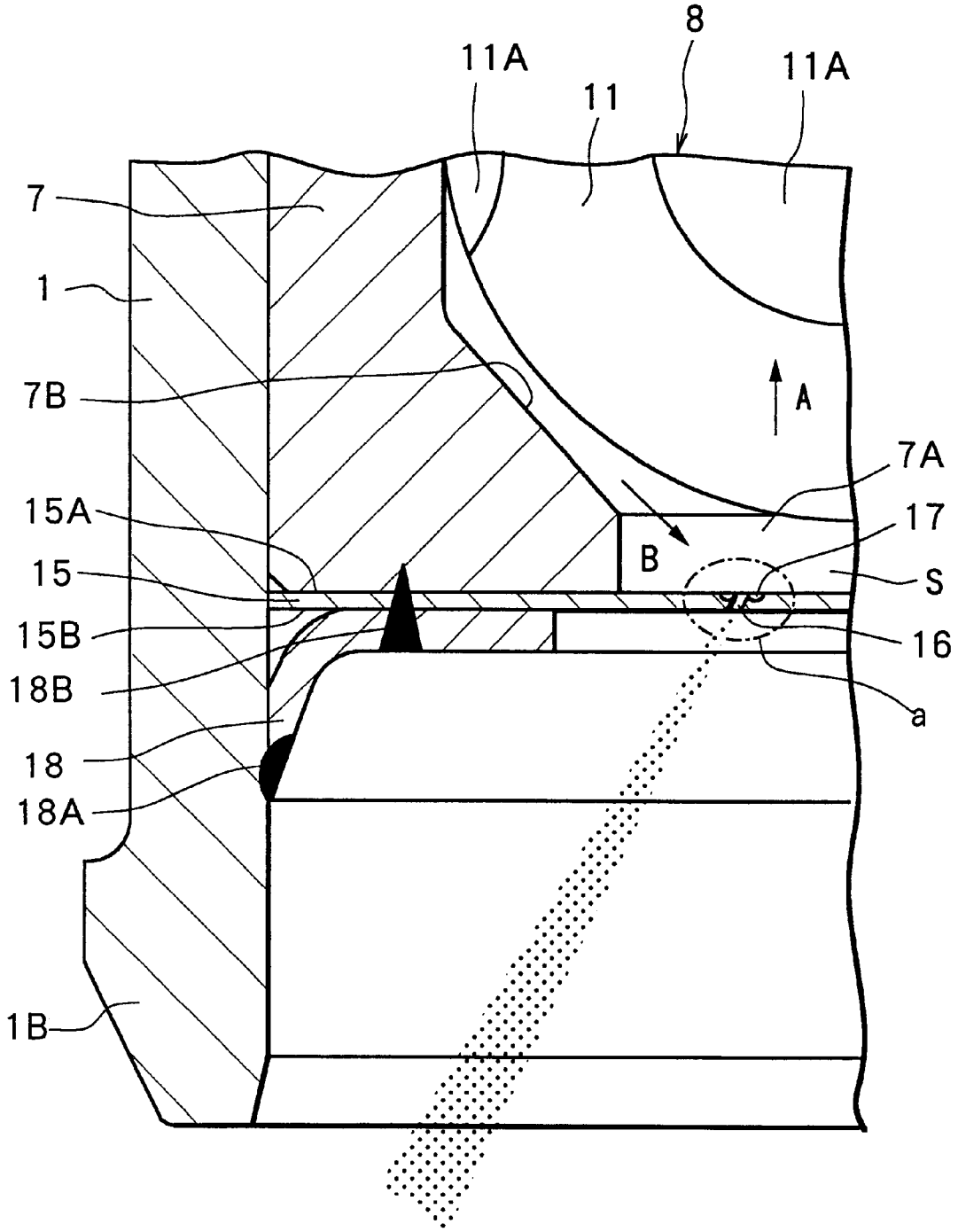
FIG. 6 is an enlarged cross-section of the main parts of the tip end of the casing showing a valve open condition.

Furthermore, when valve body 8 is opened, as shown in FIG. 6, valve body 8 is displaced in the direction of arrow A, and when valve portion 11 becomes unseated from valve seat 7B, fuel on casing 1 side flows into a space S inside injection port 7A as shown by arrow B, and the fuel is injected to the outside from respective nozzles 16 of nozzle plate 15.

Electromagnetic coil 12 serving as an actuator, is fixedly provided on the inside of resin cover 19 at the base end of casing 1.

Electromagnetic coil 12, as shown in FIG. 1, is supplied with a current using a connector 20 to magnetically attract attraction portion 10 of valve body 8, so that valve body 8 is opened in the direction of arrow A against a valve spring 13.

Valve spring 13 is a compression spring which is arranged on the inside of fuel inflow pipe 4. Valve spring 13 is provided between a cylindrical body 14 secured to the upstream side of fuel inflow pipe 4 and the base end side of valve body 8, to urge valve body 8 in the valve close direction.

Nozzle plate 15 is formed by performing press working of a disc shape metal sheet. Nozzle plate 15 has a thickness t of 0.08 to 0.25 mm and more preferably of 0.09 to 0.1 mm.

Furthermore, as shown in FIG. 3, nozzle plate 15, together with push plate 18, is secured to the tip end of valve seat member 7, and in this condition, the central portion of the surface 15A side faces valve portion 11 of valve body 8 via injection port 7A of valve seat member 7.

Figure 4:
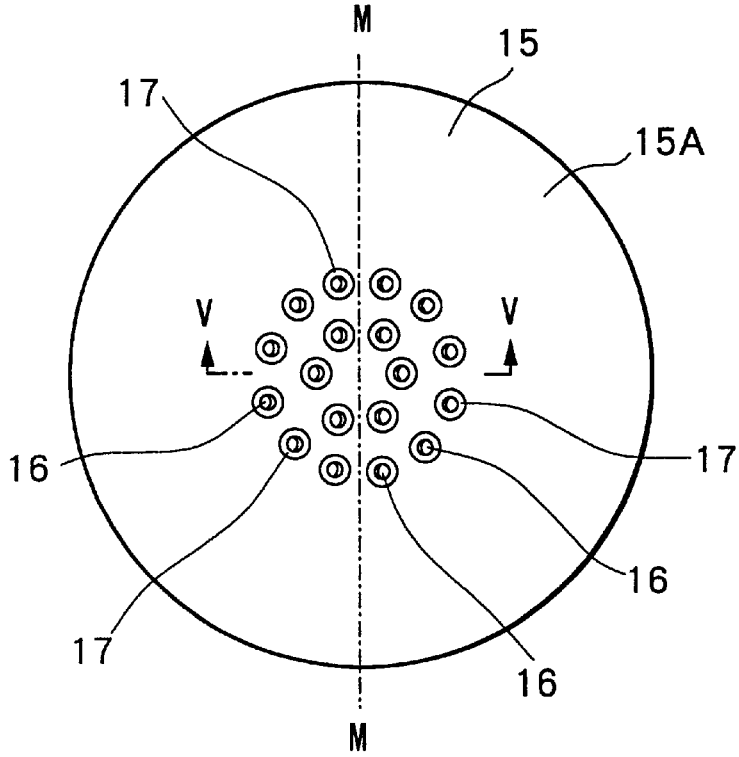
FIG. 4 is a plan view of a nozzle plate shown in FIG. 1.

At the central portion of nozzle plate 15, as shown in FIG. 4, there is provided a plurality of nozzles 16 on concentric circle. Each of nozzles 16 is formed with a diameter d0 of approximately 0.15 to 0.3 mm, and has an inflow side opening 16A on front surface 15A side of nozzle plate 15, and an outflow side opening 16B on the rear surface 15B side.

Figure 5:
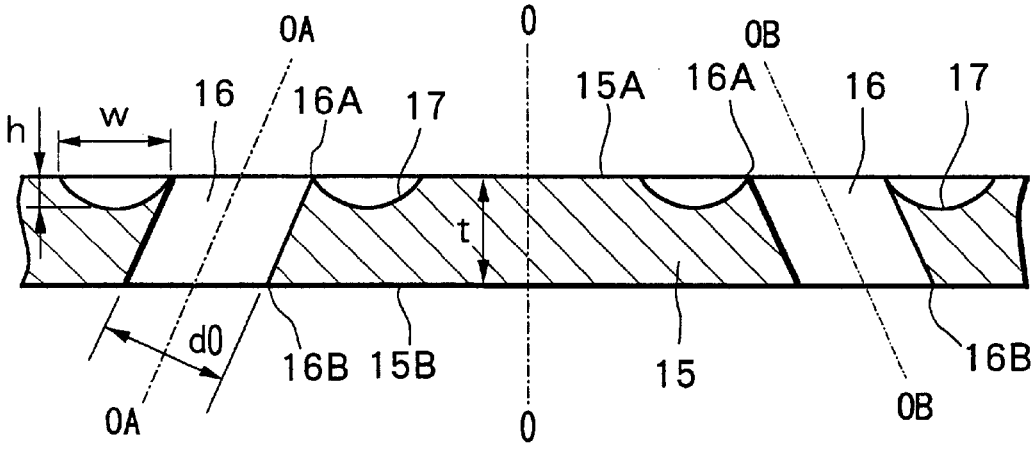
FIG. 5 is a partial cross-section of the nozzle plate viewed in the direction of arrows V—V of FIG. 4.

Furthermore, of respective nozzles 16, nozzles 16 arranged on the left side of the straight line M—M in FIG. 4 are formed along an axis OA—OA which is inclined by a predetermined incline angle to the left with respect to an axis O—O of nozzle plate 15 (refer to FIG. 5). Moreover, nozzles 16 arranged on the right side of the straight line M—M are formed along an axis OB—OB which is inclined to the right with respect to the axis O—O.

Furthermore, at valve body 8 open time, as shown in FIG. 6, fuel supplied inside casing 1 is branched to the left and right from respective nozzles 16 of nozzle plate 15 to be injected. At this time, the injected fuel is atomized by nozzles 16.

On front surface 15A side of nozzle plate 15, there are provided annular grooves 17 constituting a step portion corresponding to each of nozzles 16. Each of annular grooves 17, as shown in FIG. 4 and FIG. 5, is formed as an annular concave portion respectively surrounding inflow side opening 16A of nozzle 16, with the cross section shape thereof constituting a circular-arc shape.

Here, a dimension ratio (w/d0) of the groove width w of annular groove 17 to the diameter d0 of nozzle 16 is set to satisfy the following equation.

$$0.3<w/d0<1.0 \quad (1)$$

Furthermore, a dimension ratio (h/t) of the depth h of annular groove 17 to the plate thickness t of nozzle plate 15 is set to satisfy the following equation.

$$0.1<h/t<0.5 \quad (2)$$

Figure 7:
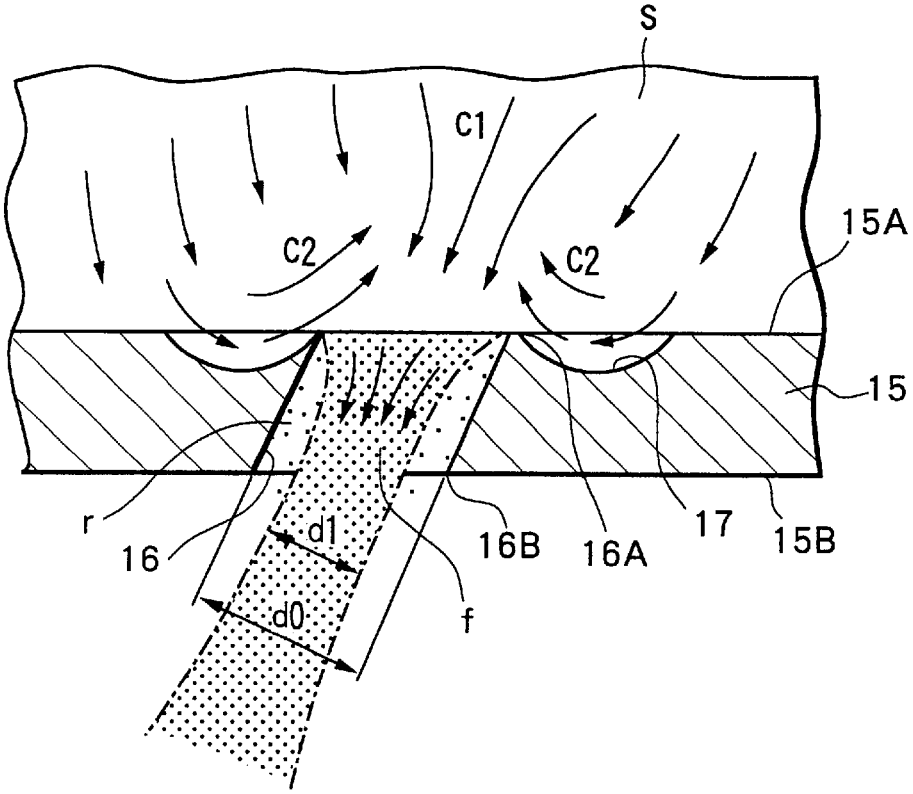
FIG. 7 is an enlarged cross-section of the main parts of the nozzle plate showing a part "a" of FIG. 6.

Moreover, as shown in FIG. 7, when valve body 8 is opened so that fuel flows into the inside of nozzle 16, annular groove 17 forms, at a position surrounding a fuel flow C1 flowing into the inside of nozzle 16, a fuel flow C2 which flows inwardly in a radial direction from the surroundings of nozzle 16 towards the central side of nozzle 16. This fuel flow C2 flows in reverse from the radial outside to collide at an incline with the fuel flow C1 directed to the inside of nozzle 16.

That is to say, annular groove 17 functions as a fuel flow forming section that forms a fuel flow which flows in reverse from the radial outside to collide at an incline with the fuel flow which flows directly into the nozzle 16.

As a result, annular groove 17 applies a constricting effect to a jet "f" (flow path area) of the fuel flowing inside nozzle 16, and a cross-section area (outer diameter dimension d1) of this jet "f" becomes smaller than the opening area (bore diameter d0) of nozzle 16 (d1<d0).

On the other hand, push plate 18 is formed from an annular metal plate. Push plate 18, as shown in FIG. 2, has an outer peripheral side welded to the inside of small diameter cylinder portion 1B of casing 1 by a weld portion 18A, and an inner peripheral side welded to the tip end of valve seat member 7 together with nozzle plate 15 by another weld portion 18B. As a result, nozzle plate 15 and valve seat member 7 are secured to the inside of casing 1.

Furthermore, resin cover 19 is fitted so as to cover large diameter cylinder portion 1A of casing 1, and as shown in FIG. 1, is provided with connector 20.

Moreover, a protector 21 is fitted to small diameter cylinder portion 1B of casing 1. Protector 21 protects nozzle plate 15.

The fuel injection valve according to the present invention has the construction as described above. Next, a method of manufacturing nozzle plate 15 will be described.

Figure 8:
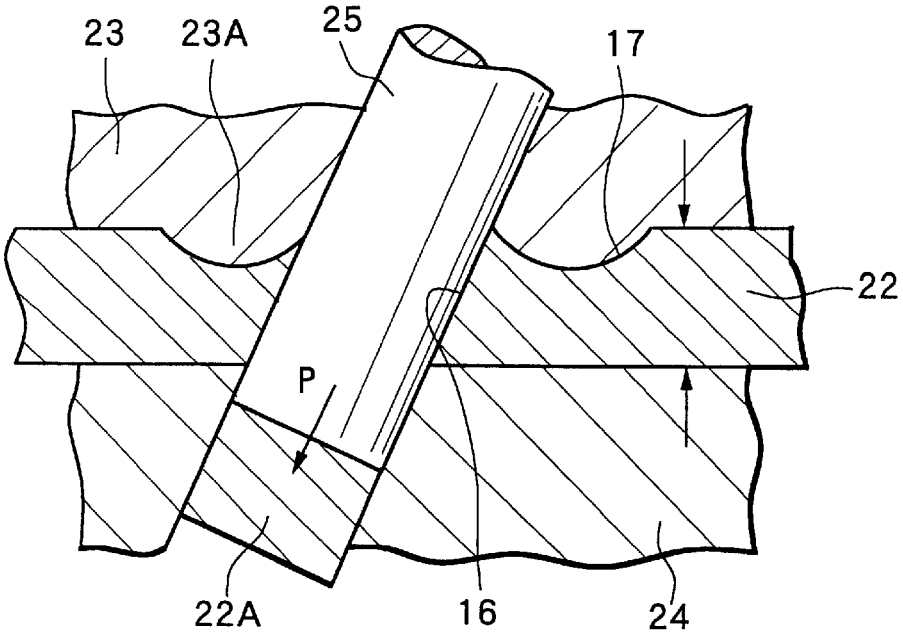
FIG. 8 is an enlarged cross-section of the main parts of the nozzle plate showing a condition where a nozzle is punched out by a fine blanking process.

At first, when manufacturing nozzle plate 15, as shown in FIG. 8, a fine blanking machine is used.

When blanking respective nozzles 16, a metal plate 22 which becomes nozzle plate 15 is arranged between a one side die 23 and the other side die 24 provided in the fine blanking machine, and by pressing metal plate 22 between dies 23 and 24, annular groove 17 is pressed on the front surface side of metal plate 22 by an annular protruding portion 23A provided on the one side die 23.

Furthermore, while holding metal plate 22 under pressure by dies 23 and 24, a punch 25 slidably provided on the one side die 23 is pushed in the direction of arrow P towards the other side die 24.

As a result, a punch part 22A is blanked from metal plate 22 to thereby form nozzle 16. Hence, nozzle plate 15 can be manufactured with a high dimensional accuracy using the fine blanking machine.

Next, the operation of the fuel injection valve which uses this nozzle plate 15 will be described.

At the time of operation of the fuel injection valve, fuel is supplied from the base end of fuel inflow pipe 4 to fuel passage 2 inside casing 1.

Then, when electromagnetic coil 12 is supplied with a current via connector 20, attraction portion 10 of valve body 8 is magnetically attracted by electromagnetic coil 12 via casing 1, fuel inflow pipe 4 and coupling core 6, so that valve body 8 is opened in the direction of arrow A in FIG. 1 against valve spring 13.

As a result, the fuel inside fuel passage 2, as shown by arrow B in FIG. 6, flows into space S inside injection port 7A after having flown between valve seat 7B of valve seat member 7 and valve portion 11 of valve body 8, and is injected from respective nozzles 16 of nozzle plate 15 towards the intake side of an engine.

Here, referring to FIG. 7 to describe the fuel flow flowing into space S inside injection port 7A, at first, a part of the fuel which has flown into the inside of space S flows towards inflow side opening 16A of nozzle 16, so as to form the fuel flow C1.

Furthermore, the fuel inside space S also flows into annular groove 17, and this fuel, since the fuel flow C1 has been formed on the inner peripheral side of annular groove 17, is guided inwardly in a radial direction along the peripheral wall of annular groove 17 to nozzle 16 side, to form the fuel flow C2 surrounding nozzle 16.

Then, this fuel flow C2 is finally guided towards an incline face (step portion) rising up towards a nozzle opening rim on the inner side of annular groove 17. As a result, this fuel flow C2 flows in a somewhat reverse direction from the radial outside to collide at an incline with the fuel flow C1 which flows directly into the inside of nozzle 16, and thus acts so as to contract the flow path area of the flow C1.

Therefore, for the main part of fuel flowing inside nozzle 16, as shown by the two dot chain line in FIG. 7, a phenomena referred to as jet contraction is produced so that this main part of fuel becomes jet "f" separated from the peripheral wall of nozzle 16, to flow through in a straightened flow condition on the central side of nozzle 16.

Consequently, for jet "f" injected from nozzle 16, the outer diameter dimension d1 thereof becomes less than the bore diameter d0 of nozzle 16, thus attaining a condition practically the same as for the case where fuel is injected from a nozzle with an outer diameter dimension d1 as the bore diameter.

As a result, at the time of injecting fuel, due to annular groove 17, the substantial injection bore diameter (outer diameter dimension d1) of nozzle 16 can be made smaller than the actual bore diameter d0, and corresponding to this outer diameter dimension d1, the injected fuel can be easily atomized.

Furthermore, at this time, since an annular turbulent region "r" surrounding fuel jet "f" is formed inside nozzle 16, by means of this turbulent region "r", atomization of fuel can be promoted.

Figure 9:
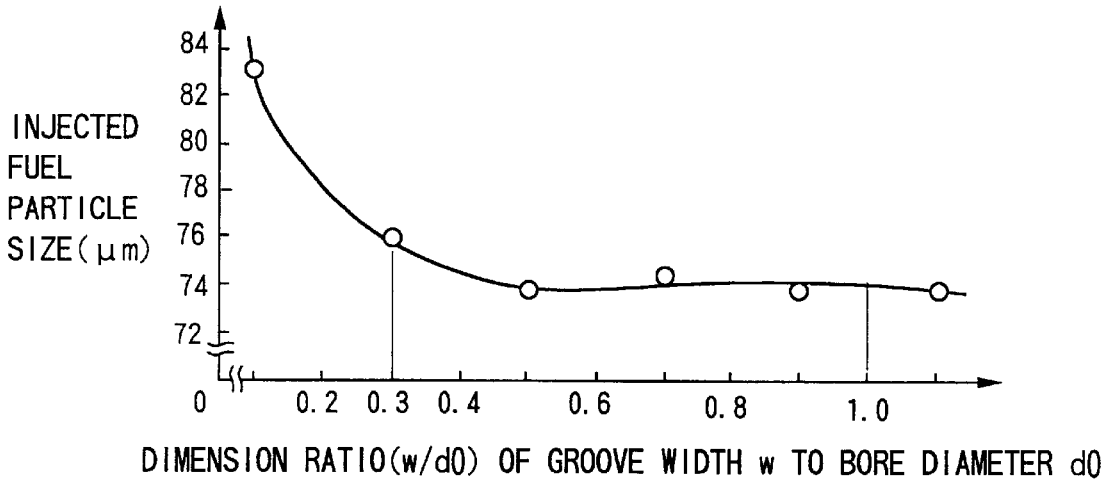
FIG. 9 is a characteristic diagram showing a relation between groove width of an annular groove and nozzle bore diameter.

The particle diameter (particle size) of the injected fuel atomized in this way, as shown in FIG. 9, is changed in accordance with the dimension ratio (w/d0) of the groove width w of annular groove 17 to the bore diameter d0 of nozzle 16.

In this case, when the dimension ratio (w/d0) is set to a size equal to or less than 0.3, the particle size of the injected fuel becomes large. However, by setting the dimension ratio (w/d0) to a value greater than 0.3, the particle size of the injected fuel can be made sufficiently minute.

However, since the spacing of respective nozzles must be made large to correspond to the groove width w of annular grooves 17, when designing the injection valve, if the dimension ratio (w/d0) is set to a size equal to or greater than 1.0, it becomes difficult to arrange the plurality of nozzles 16 at appropriate spacing within a fixed area range.

Consequently, by setting the ratio of the groove width w of annular grooves 17 to the bore diameter d0 of nozzle 16 to satisfy the aforementioned equation (1), the degree of freedom in designing nozzle plate 15 can be ensured while maintaining sufficiently atomization of the injected fuel.

Furthermore, the particle size of the injected fuel is also changed depending on the groove depth h of annular grooves 17.

Figure 10:
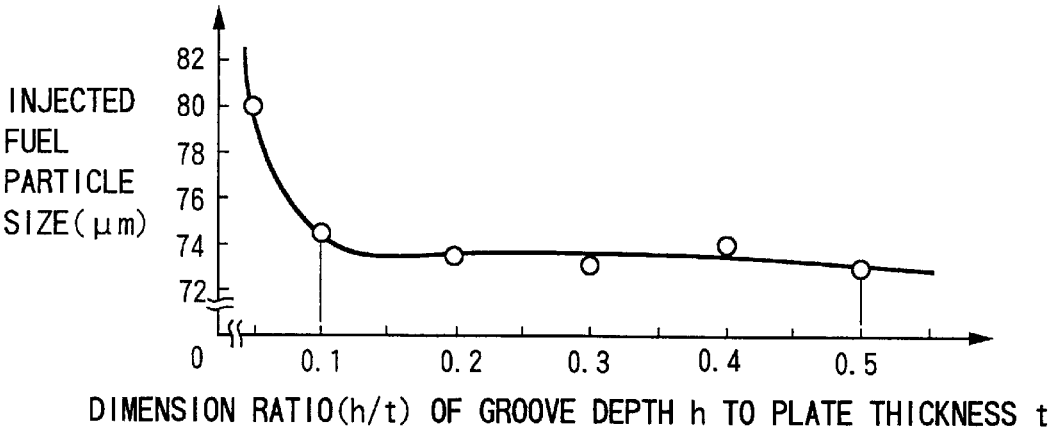
FIG. 10 is a characteristic diagram showing a relation between groove depth of the annular groove and plate thickness of the nozzle plate.

In this case, as shown in FIG. 10, when the dimension ratio (h/t) of the groove depth h of annular groove 17 to the plate thickness t of nozzle plate 15 is set to a size equal to or less than 0.1, the particle size of the injected fuel becomes large.

On the other hand, by setting the dimension ratio (h/t) to a value greater than 0.1, atomization of the fuel can be promoted.

However, if the dimension ratio (h/t) is set to a size equal to or greater than 0.5, there is a possibility of reduction in rigidity of nozzle plate 15 at the position of annular grooves 17.

Consequently, by setting the ratio of the groove depth h of annular grooves 17 to the plate thickness t of nozzle plate 15 to satisfy the aforementioned equation (2), the function of annular grooves 17 can be sufficiently achieved, and also the strength of nozzle plate 15 can be ensured.

In this manner, according to the present embodiment, the construction is such that annular grooves 17 surrounding each nozzle 16 are provided on front surface 15A side of nozzle plate 15. Therefore, when valve body 8 is opened, the fuel flow C2 can be formed by annular grooves 17, which flows inwardly in a radial direction from the surroundings of nozzle 16 towards the central side of nozzle 16. This fuel flow C2 can be made to flow in a somewhat reverse direction from the radial outside to collide at an incline with the fuel flow C1 flowing directly into nozzle 16.

As a result, at the time of fuel injection, the outer diameter d1 of jet "f" flowing through the inside of nozzle 6 can be stably contracted. Hence, the substantial bore diameter of nozzle 16 corresponding to this outer diameter d1 can be made smaller than the actual bore diameter d0.

Consequently, it is not necessary to arduously make the diameter d0 of nozzle 16 minute using a special punch or drill. Hence, by means of a simple construction using annular grooves 17, the injected fuel can be efficiently atomized. Moreover, engine combustion conditions can be kept favorable, and performance and reliability as a fuel injection valve can be improved.

Furthermore, since the cross-section shape of annular grooves 17 is formed in a concave circular-arc, the peripheral wall thereof can be formed smooth with respect to the radial direction. Hence, the fuel flowing into the inside of annular grooves 17 can be smoothly guided to the radial inside towards nozzle 16, and also this fuel flow C2 can be stably maintained.

Figure 11:
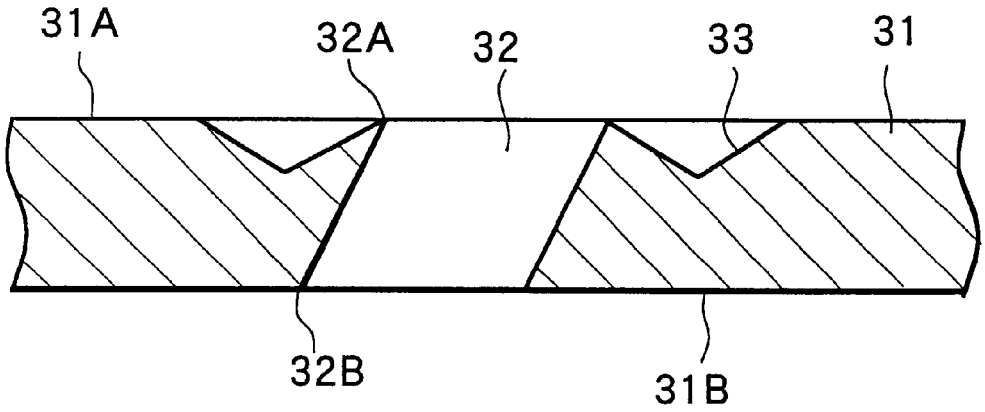
FIG. 11 is a partial cross-section of a nozzle plate showing a second embodiment.

FIG. 11 shows a second embodiment. The characteristic of this second embodiment is that the cross-section shape of annular groove constituting the step portion is formed in a triangular shape.

A nozzle plate 31 in the second embodiment is formed from a metal plate in substantially the same manner as for the first embodiment, and is provided with a plurality of nozzles 32. For respective nozzles 32, there is provided an inflow side opening 32A and an outflow side opening 32B.

An annular groove 33, as with the first embodiment, is formed on a front surface 31A side of nozzle plate 31, surrounding each nozzle 32. However, annular groove 33 in the second embodiment has a triangular shape cross-section.

In this manner, also in the second embodiment constructed in this way, annular groove 33 functions as a fuel flow forming section that forms a fuel flow which flows in reverse from the radial outside to collide at an incline with the fuel flow which flows directly into nozzle 32. Hence, an operation effect substantially the same as for the first embodiment can be obtained.

Figure 12:
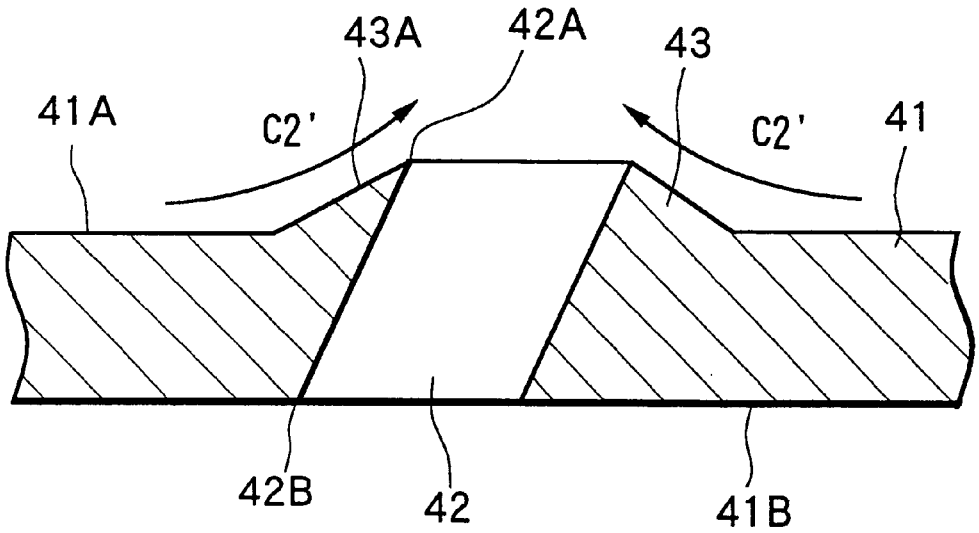
FIG. 12 is a partial cross-section of a nozzle plate showing a third embodiment.

Next, FIG. 12 shows a third embodiment. The characteristic of the third embodiment is that an annular protrusion is provided on the front surface side of nozzle plate to construct a step portion.

A nozzle plate 41 in the third embodiment is formed from a metal plate in substantially the same manner as for the first embodiment, and is provided with a plurality of nozzles 42. For respective nozzles 42, there is provided an inflow side opening 42A and an outflow side opening 42B.

An annular protrusion 43 is formed on a front surface 41A side of nozzle plate 41, corresponding to each nozzle 42. Annular protrusion 43 preferably has a protrusion dimension of around 0.01 to 0.05 mm, and projects from front surface 41A of nozzle plate 41.

Furthermore, there is provided an inclined surface 43A inclined in an approximate cone shape, on the outer peripheral side of annular projection 43, and inflow side opening 42A of nozzle 42 is opened on a projecting edge side of annular projection 43.

As a result, when valve body 8 is opened, a fuel flow C2' can be formed which flows radially from the periphery of nozzle 42 to the center side of nozzle 42 along inclined surface 43A which rises up towards the nozzle opening rim of annular projection 43.

Accordingly, annular projection 43 functions as a fuel flow forming section that forms a fuel flow which flows in reverse from the radial outside to collide at an incline with the fuel flow which flows directly into nozzle 16. Hence, an operation effect substantially the same as for the first embodiment can be obtained.

Here, in the first and second embodiments, the construction is such that the cross-section shape of annular grooves 17 and 33 is formed in a circular-arc or a triangular shape. However, the present invention is not limited to this, and the construction may be such that the cross-section shape of annular grooves is formed in a square or rectangular cross-section shape.

The entire contents of Japanese Patent Application No. 2001-022270, filed Jan. 30, 2001 are incorporated herein by reference.

What is claimed is:

1. A fuel injection valve comprising:

a valve body;

a casing having a valve seat for seating said valve body, and a bore for movably supporting said valve body; and a nozzle plate with a plurality of nozzles opened therein, disposed downstream of said valve body, wherein said nozzle plate is provided with annular step portions each located on the periphery of a nozzle opening rim on a valve seat side, which rises up towards said nozzle opening rim from the radial outside of said nozzle.

2. A fuel injection valve according to claim 1, wherein said step portion is formed by an annular groove surrounding said nozzle opening rim on the valve seat side.

3. A fuel injection valve according to claim 2, wherein a cross-section shape of said groove is a circular-arc shape.

4. A fuel injection valve according to claim 2, wherein a cross-section shape of said groove is a triangular shape.

5. A fuel injection valve according to claim 2, wherein a ratio w/d0 of a width w of said groove to a bore diameter d0 of said nozzle, satisfies: $0.3<w/d0<1.0$.

6. A fuel injection valve according to claim 2, wherein a ratio (h/t) of a depth h of said groove to a plate thickness t of said nozzle plate satisfies: $0.1<h/t<0.5$.

7. A fuel injection valve according to claim 1, wherein said step portion is formed by an annular protrusion surrounding said nozzle opening rim on the valve seat side.

8. A fuel injection valve comprising:

a valve body;

a casing having a valve seat for seating said valve body, and a bore for movably supporting said valve body; and a nozzle plate with a plurality of nozzles opened therein, disposed downstream of said valve body, wherein said nozzle plate is provided with a fuel flow forming section that forms a fuel flow which flows in reverse from the radial outside to collide at an incline with a fuel flow which flows directly into said nozzle.

* * * * *